US008365689B2

(12) United States Patent
Gruber et al.

(10) Patent No.: US 8,365,689 B2
(45) Date of Patent: Feb. 5, 2013

(54) INTERNAL COMBUSTION ENGINE IGNITION DEVICE

(75) Inventors: Friedrich Gruber, Hippach (AT); Markus Kraus, Wiesing (AT)

(73) Assignee: GE Jenbacher GmbH & Co. OHG, Jenbach (AT)

( * ) Notice: Subject to any disclaimer, the term of this patent is extended or adjusted under 35 U.S.C. 154(b) by 0 days.

(21) Appl. No.: 13/431,038

(22) Filed: Mar. 27, 2012

(65) Prior Publication Data

US 2012/0180744 A1 Jul. 19, 2012

Related U.S. Application Data

(63) Continuation of application No. PCT/AT2010/000348, filed on Sep. 23, 2010.

(30) Foreign Application Priority Data

Oct. 7, 2009 (AT) ..... A 1580/2009

(51) Int. Cl.
*F01P 3/16* (2006.01)

(52) U.S. Cl. ..... 123/41.55; 123/41.72; 123/169 PA

(58) Field of Classification Search ..... 123/41.72, 123/169 C, 169 PA, 41.55
See application file for complete search history.

(56) References Cited

U.S. PATENT DOCUMENTS

| | | | | |
|---|---|---|---|---|
| 1,539,133 | A * | 5/1925 | Markle et al. | 165/51 |
| 3,765,384 | A * | 10/1973 | Barnard | 123/41.32 |
| 5,233,947 | A * | 8/1993 | Abe et al. | 123/41.79 |
| 5,662,082 | A * | 9/1997 | Black et al. | 123/254 |
| 5,947,076 | A * | 9/1999 | Srinivasan et al. | 123/267 |
| 6,513,483 | B2 * | 2/2003 | Riggs | 123/254 |
| 7,334,545 | B2 * | 2/2008 | Muller | 123/41.31 |
| 7,721,683 | B2 * | 5/2010 | Lutz et al. | 123/41.1 |
| 8,181,617 | B2 * | 5/2012 | Kuhnert et al. | 123/143 B |
| 2002/0005182 | A1 * | 1/2002 | Kraus et al. | 123/169 C |

FOREIGN PATENT DOCUMENTS

| | | |
|---|---|---|
| DE | 10 2006 000 098 | 9/2006 |
| EP | 1 519 038 | 3/2005 |
| EP | 2 072 803 | 6/2009 |
| JP | 53-1734 | 1/1978 |
| JP | 57-153923 | 9/1982 |
| JP | 57-171292 | 10/1982 |
| JP | 5-306648 | 11/1993 |
| JP | 7-14596 | 1/1995 |
| JP | 2004-150276 | 5/2004 |
| JP | 2006-274940 | 10/2006 |
| JP | 2009-121422 | 6/2009 |

OTHER PUBLICATIONS

International Search Report issued Mar. 17, 2011 in International (PCT) Application No. PCT/AT2010/000348.
Austrian Patent Office Search Report issued Apr. 1, 2010 in Austrian Patent Application No. A 1580/2009.

* cited by examiner

*Primary Examiner* — Stephen K Cronin
*Assistant Examiner* — Arnold Castro
(74) *Attorney, Agent, or Firm* — Wenderoth, Lind & Ponack, L.L.P.

(57) ABSTRACT

The invention relates to an arrangement including an internal combustion engine ignition device having a spark plug and a spark plug seat (in which the spark plug can be fastened in a fastening zone), and a cylinder head in which the spark plug is or can be mounted via the spark plug seat. The cylinder head has a cylinder head cooling cavity. The spark plug seat includes a temperature control medium chamber which is separate from the cylinder head cooling cavity and has a cooling medium feed line and a cooling medium discharge line. The temperature control medium chamber and the cylinder head cooling cavity are connected to separate medium temperature control devices and form separate medium systems.

28 Claims, 4 Drawing Sheets

INTERNAL COMBUSTION ENGINE IGNITION DEVICE

This application is a Continuation of International Application No. PCT/AT2010/000348, filed Sep. 23, 2010, the entire disclosure of which is incorporated herein by reference.

BACKGROUND OF THE INVENTION

The invention concerns an arrangement including an internal combustion engine ignition device having a spark plug and a spark plug mounting in which the spark plug can be fastened in a fastening region, and a cylinder head in which the spark plug is or can be mounted by way of the spark plug mounting. The cylinder head has a cylinder head cooling cavity, and the spark plug mounting has a temperature control medium chamber which is separate from the cylinder head cooling cavity and has a medium feed conduit and a medium discharge conduit. The invention further concerns an internal combustion engine ignition device including a spark plug, a spark plug mounting which receives the spark plug and which can be fitted in a cylinder head of an internal combustion engine, as well as an internal combustion engine, in particular a gas engine, having the arrangement and internal combustion engine ignition device.

In the case of internal combustion engines, particularly stationary gas engines, there are basically two possible ways of fitting or screwing spark plugs in a cylinder head.

The first option is that of screwing the spark plug directly into a screwthreaded bore on the cylinder head end. The screw-in screwthread is in that case provided directly in the casting material of the cylinder head.

The second possibility involves providing a separate spark plug mounting (spark plug sleeve) which in turn is screwed or clamped in the cylinder head. Particularly in the case of gas engines with prechamber ignition—that is to say where mixture ignition is effected by means of ignition sparks in a prechamber and from there a mixture is ignited in the main combustion chamber by way of the ignition jets issuing from the transfer bores—it is necessary to use separate spark plug mountings for structural reasons.

Intensive development activities in the field of gas engines in recent years have meant that it has been possible to greatly increase the specific power levels (for example power per piston displacement) of the gas engines. The result of this however is that the spark plugs are subjected to a high thermal loading. Therefore the methods of cooling used hitherto are in part no longer sufficient.

To avoid severe heating of the spark plugs in the high-load mode of the engine, the spark plug mountings are generally water-cooled for that reason. Particularly with high thermal loadings it is already known to provide cooling bores in the spark plug mounting in order to pass the cooling medium in the cylinder head closer to the spark plug screwthread and there achieve a better cooling action. A disadvantage in that respect is inter alia that temperature control of the spark plug is always dependent on the temperature of the cooling medium in the cylinder head cooling cavity and the bores only extend in point configuration in the direction of the spark plug. As a result, this does not involve uniform temperature control of the spark plug.

In that respect, JP 7-14596 discloses a spark plug mounting, by way of which a spark plug is fitted in a cylinder head. In that case, a cooling chamber is provided in the cylinder head and a water passage is provided in the spark plug mounting. Those two water passages or chambers are supplied from a single common water supply and are connected together.

The disadvantage with that configuration is that the temperatures of the cooling passages always influence each other. In other words, if for example, the water in the region of the spark plug mounting is very greatly heated, then during the further cooling operation that also has a strong inevitable direct influence on the temperature of the cooling medium in the cylinder head.

SUMMARY OF THE INVENTION

Therefore, the object of the invention is to provide improved temperature control of the spark plug. In particular, the invention seeks to provide that temperature control by way of the spark plug mounting can be better adapted to the high-power mode of operation. In addition the invention seeks to permit specifically targeted temperature control of different regions.

For an arrangement having the features of the classifying portion of the present invention, that object is attained in that the temperature control medium chamber and the cylinder head cooling cavity are connected to separate medium temperature control devices and form separate medium circuits. That makes it possible to achieve specifically targeted temperature control in the region of the spark plug mounting, which is adjustable substantially independently of the general cylinder head cooling. According to the invention, therefore, the temperature control circuit for the spark plug sleeve is separated from the remaining temperature control circuit of the engine in order thereby to be able to use different media or employ different temperature levels for temperature control. For example, the temperature level of the low-temperature stage of mixture cooling which is usually between 30 and 60° C. can also be employed. It is, however, also possible to provide a circuit for temperature control of the spark plug sleeves, which circuit is operable independently of the existing circuits of the engine, for example, being acted upon by way of a heat exchanger with ambient air or with untreated water. It can preferably also be provided that media other than water are used as coolant. For example it would also be possible to provide cooling with air, $CO_2$ or other gases, or however also with other liquids such as refrigerant or liquid $CO_2$.

For an internal combustion engine ignition device having the features of the classifying portion of the present invention—which is directed only to the spark plug and the spark plug mounting—the specified object is attained in that the spark plug mounting has a temperature control medium chamber with a cooling medium feed conduit and a cooling medium discharge conduit. The temperature control medium chamber is in the form of a passage guided in a helical form in the spark plug mounting. The helical flow of the temperature control medium in a passage around the spark plug makes it possible to achieve substantially more specifically targeted, more intensive and faster temperature control over a larger surface area, than is possible with individual bores in the spark plug mounting. In particular radially homogeneous temperature distribution is achieved by the helical configuration of the passage.

The preferred embodiments described herein—insofar as they concern the respective features—are to be viewed as preferred variants both in regard to the arrangement with spark plug, spark plug mounting and cylinder head and also for the internal combustion engine ignition device only with spark plug and spark plug mounting.

According to a preferred embodiment, that the spark plug can be in the form of a laser spark plug having a laser light producing device and a coupling-in optical means arranged at the combustion chamber side for coupling laser light into the combustion chamber of an internal combustion engine.

Laser ignition is an ignition system which is in an intensive development phase and which has fundamental advantages over conventional spark ignition. One of those advantages is the absence of erosive wear as well as hot corrosion at the spark plug electrodes which in conventional electric spark ignition, specifically in relation to the high power density levels of modern gas engines, lead to reduced spark plug service lives and thus considerable operating costs. The increase in power density of the engine, which counts among the main focuses in engine development, does not represent any difficulty for laser ignition.

Laser ignition to which reference is made in this proposed invention comprises a laser spark plug in which the laser light pulse which lasts only for a few nanoseconds is produced with a sufficiently high energy. The laser light beams issuing from, for example, a laser crystal are concentrated and focused by way of a suitable optical means and coupled into the combustion chamber by way of a light-transmissive window, the so-called coupling-in optical means, or the combustion chamber window, at the end of the laser spark plug, that is at the combustion chamber side. The plasma spark or the ignition spark is produced at the focal point of the laser light beams. The laser ignition system also has an optical pumping device where a quasi-continuous laser light of suitable wavelength is produced, which is passed by way of a glass fiber cable to the laser crystal in the laser spark plug and with which that is activated until the laser pulse is triggered. To ensure optimum and reliable operation of the laser crystal with the integrated optical interfaces and switches, it is crucial that the temperature of the laser spark plug at the location of installation of the laser crystal is kept as low as possible. In the case of large high-power output gas engines, the components defining the combustion chamber are subjected to very high thermal loadings, added to that there are often long spark plug shafts into which the spark plugs are fitted, and where the wall temperatures are already about 90° C. No higher temperature than a maximum of 130° C. should occur at the laser crystal in operation. That can be achieved in optimum fashion by the present invention.

A preferred variant can provide that the medium temperature control devices have their own pumps for circulation of the medium in the separate circuits.

Any suitable substances can be used as the temperature control medium, such as for example air, water, $CO_2$ or other liquid coolants which are known for example from the refrigerating art.

A further preferred variant can provide that the spark plug mounting has an inner portion and an outer portion, between which there is a temperature control medium chamber. In particular, it is advantageous in that respect if the inner portion of the spark plug mounting has a thickness of a maximum of 5 mm, preferably a maximum of 3 mm, substantially over the entire spark plug mounting length. In that respect, essentially only the region of the inner portion, which in terms of length adjoins the temperature control medium receiving means, is meant as the spark plug mounting length. It is generally advantageous if the spark plug mounting has a sleeve-shaped configuration or is in the shape of a cylindrical surface, whereby screwing into the cylinder head is facilitated.

To achieve uniform temperature control without distortion of the spark plug mounting or other parts, the temperature control medium chamber can be provided substantially in the entire length of the spark plug mounting.

The configuration of the spark plug sleeve is preferably such that provided within the sleeve is a cavity, in which the coolant in the spark plug mounting is passed by way of a directed flow to as close as possible to the end at the combustion chamber side or to the thread of the spark plug and completely embraces the same. The coolant is fed by way of one or more passages from below or from the side. The passages preferably open tangentially into the coolant chamber and thereby produce a twisting flow (for example, by means of guide contours or guide vanes in the wall) in the coolant chamber about the axis of the spark plug sleeve. The feed passages open into the chamber, for example, in such a way that the region of the spark plug sleeve which is closest to the combustion chamber has an afflux flow thereagainst and as a result is intensively cooled. The coolant is then guided upwardly along the wall of the threaded bore, there goes to the contact surface of the seat of the spark plug and is finally further guided upwardly by way of the cavity between the outer and inner walls of the spark plug sleeve, where the coolant is discharged. The feed of the coolant can however also occur from the upper end of the spark plug sleeve, in which case the coolant chamber is then 'divided into two', with a chamber portion in which the coolant is guided down to the bottom and a chamber portion in which the coolant is guided up again to the discharge opening. The geometrical configuration of those chamber portions is in that case preferably such that there is a flow of coolant which passes around the axis of the sleeve. For example, the coolant chamber walls may have screw-shaped recesses. The wall portion of the spark plug sleeve between the spark plug and the coolant is in that case as thin as possible and has a wall thickness of not more than about 3 mm over the entire length of the mounting bore. That ensures minimum heat conduction paths and a correspondingly intensive temperature control effect.

Production of a spark plug sleeve in the described manner can be effected for example by the sleeve having of a two-part structure, comprising an inner portion receiving the spark plug and an outer portion connected to the cylinder head. The two portions can be connected together by welding, soldering or brazing, adhesive or by way of a press connection. It is, however, also possible to produce a spark plug sleeve of the described kind by way of a fine casting process. When using a two-part structure, the choice of material can be such that an optimum compromise is achieved between heat conduction and strength, with a minimum wall thickness.

To achieve a temperature distribution which is radially as homogeneous as possible, it can particularly preferably be provided that the helical passage leads from the end, remote from the combustion chamber, of the spark plug mounting, to the end at the combustion chamber side, and with opposite helicity to the end remote from the combustion chamber again. That also provides that the medium feed and discharge is arranged at the end of the spark plug mounting, that is remote from the combustion chamber. That configuration provides that, as seen in the axial direction of the spark plug, a feed passage and a discharge passage are always arranged alternately in the spark plug mounting, thereby providing a temperature distribution which is as uniform as possible over the entire length. The above-mentioned feed chamber portion and discharge chamber portion can, in that case, preferably be twisted or turned in opposite relationship. It is however also possible for the feed chamber portion to be arranged radially inwardly and the discharge chamber portion to be arranged radially outwardly.

A preferred variant can further provide that the temperature and/or the quantitative through-put of the medium in the temperature control medium chamber is controllable or regulatable depending on engine load or engine operating condition by a control and/or regulating unit.

In a further proposed solution based thereon, the performance of the temperature control effect, for example the amount of the temperature control medium feed and/or the temperature of the temperature control medium, is controlled or regulated depending on the operating conditions of the engine. That is particularly appropriate for the reason that, when starting at idle and with a low part load, higher temperatures at the spark plug are advantageous, but the aim is for temperatures which are as low as possible under high-load conditions. A suitable control parameter could accordingly represent, for example, the engine power.

In the event of a fresh start after a prolonged stoppage time, cooling-down of the engine preheating of the spark plug sleeve can be desirable in order, for example, to vaporize the water droplets which have condensed at the spark plug surface at the combustion chamber side or to dry the surfaces. Water droplets or moisture at the surface at the combustion chamber side can lead to shunts in the case of electric spark plugs and can lead to worsening of focusability of the laser beams and thus failure of the ignition system in the case of laser spark plugs.

The heat to be dissipated from the spark plug sleeve is only a small fraction of the total engine cooling water heat (for example less than 3%) so that the required heat exchangers are relatively small and thus inexpensive and energy losses are not significant.

It can advantageously further be provided that the total surface area of the temperature control medium chamber on the side towards the spark plug (inward side) is of approximately the same size as the total internal surface area of the spark plug sleeve, into which the spark plug is screwed.

An internal combustion engine, in particular a gas engine, can have an arrangement as described above or an internal combustion engine ignition device as described above.

BRIEF DESCRIPTION OF THE DRAWINGS

Further details and advantages of the invention are described more fully hereinafter by means of the specific description with reference to the embodiments illustrated by way of example in the drawings, in which.

DETAILED DESCRIPTION OF THE INVENTION

Figure 1:
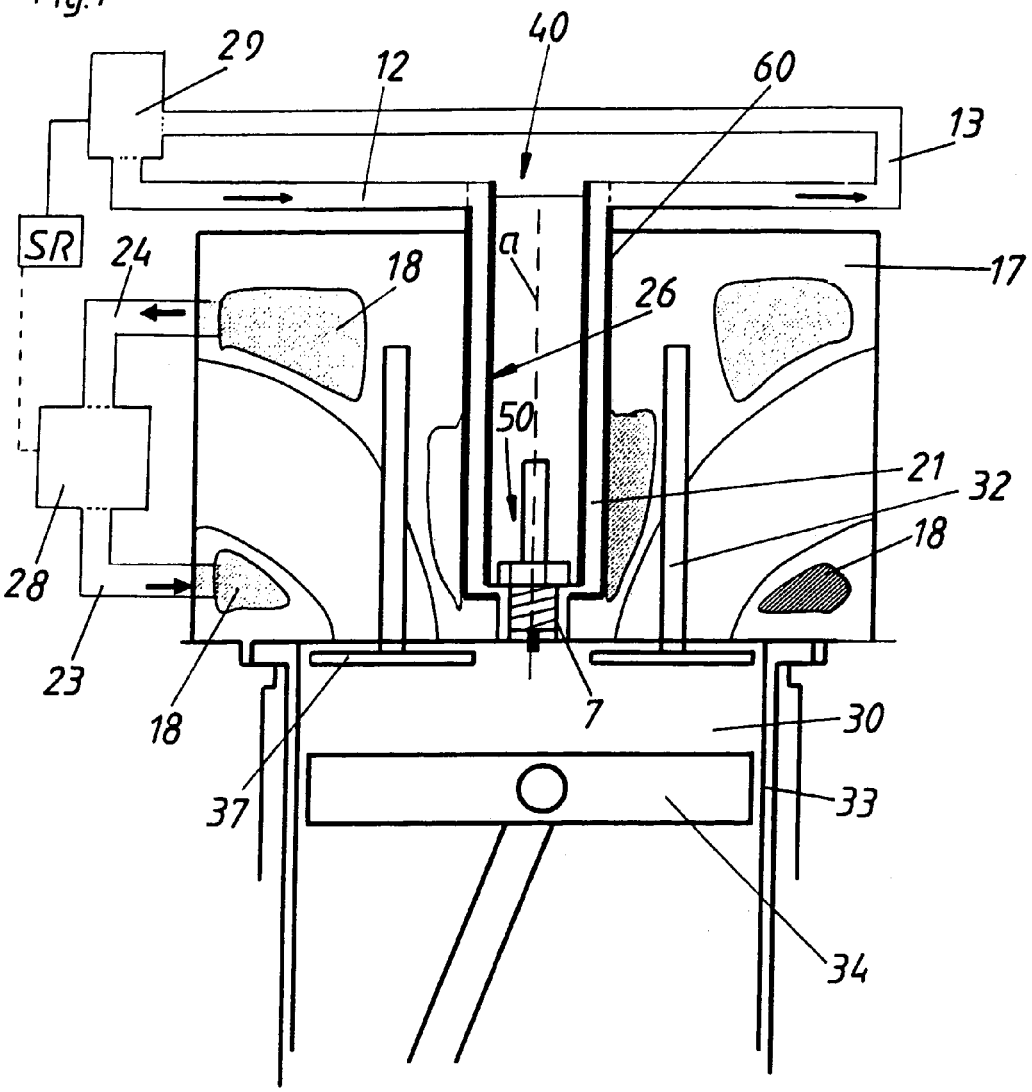
FIG. 1 shows a diagrammatic cross-section through an arrangement with cylinder head, spark plug mounting and spark plug.

FIG. 1 shows a diagrammatic cross-section through an arrangement with cylinder head 17, spark plug mounting 60 and spark plug 50 for the situation of use of an engine with direct ignition. In this case, the ignition spark is produced (directly) in the working cylinder of the engine. The engine (of which only a portion is shown) includes in this case inter alia a cylinder 33 with a piston 34 arranged therein and a combustion chamber 30 of an internal combustion engine. An ignitable fuel-air mixture can be introduced into the combustion chamber 30 by way of an inlet valve 32 and can be ignited by the spark plug 50. After combustion, the exhaust gases are carried away by way of the exhaust valve 37. The spark plug 50 and the spark plug mounting 60 together form the internal combustion engine ignition device 40 which is or can be screwed/clamped in the cylinder head 17. Cylinder head cooling cavities 18 (engine cooling water chambers) are shown in section in the cylinder head 17. Those cavities are preferably of a continuous configuration, wherein the feed of cooling medium is through a cylinder cooling feed conduit 23 and the discharge is through a cylinder cooling discharge conduit 24, wherein that circuit (the cooling medium flow)—as diagrammatically shown—is kept in operation by a first cooling medium temperature control device 28. For that purpose, a pump can be provided in the first cooling medium temperature control device 28.

The spark plug mounting 60 has the temperature control medium chamber 21 into which the medium 35 is fed by way of the cooling medium feed conduit 12 and passed as closely as possible to the most highly heat-loaded regions (for example, electrodes) of the spark plug 50. The return is along the medium discharge conduit 13 to a second cooling medium temperature control device 29 (with pump). For that purpose, the control and/or regulating unit (regulating unit) SR can control or regulate the quantitative through-put of medium 35 and the temperature of the medium 35 based on the engine power or, however, also based on (temperature) sensors arranged for example in the region of the spark plug 50. If desired or necessary, the control and/or regulating unit (regulating unit) SR can also control or regulate the cooling medium temperature control device 28 of the cylinder head 17.

A radially homogeneous temperature distribution along the inward outside surface 26 of the spark plug mounting 60 can be achieved by the passage 27 (not shown here) which preferably extends helically around the axis a of the spark plug. In that way the air in the hollow region of the spark plug mounting 60 is also uniformly cooled and optimum temperature control can be achieved depending on the respective configuration of the spark plug 50. Particularly preferably, before the internal combustion engine is brought into operation, a heating medium can be introduced, which vaporises the condensation water which has collected in hollow regions because of the engine previously cooling down.

Figure 2:
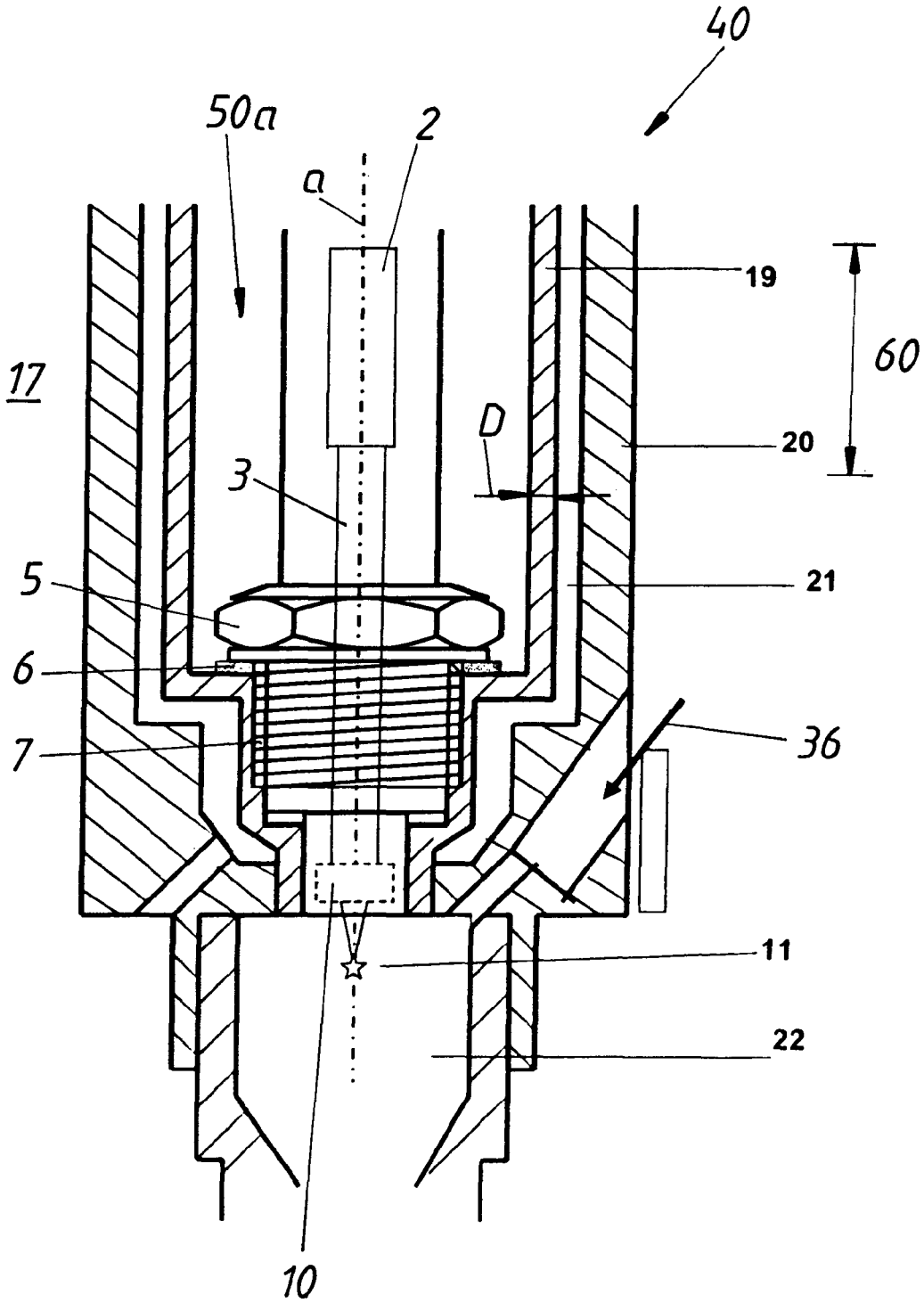
FIG. 2 shows a diagrammatic section through the spark plug mounting with spark plug.

FIG. 2 shows a diagrammatic section through a spark plug mounting 60 together with spark plug 50, in which respect unlike FIG. 1 this shows a laser spark plug 50*a*, while the ignition spark is generated in a gas-flushed prechamber 22. During the compression process in the working cylinder, fuel gas-air mixture flows out of the main combustion chamber 30 into the prechamber 22, is enriched with flushing gas which flows in by way of the passage 36, and is ignited by the (plasma) sparks of the laser spark plug 50*a*. After ignition of the prechamber mixture, ignition of the mixture takes place in the main combustion chamber 30 by way of the ignition jets issuing from the prechamber 22 through the transfer openings. The flushing gas passage 36 is secured by a valve (not shown) (for example a non-return valve) to prevent the discharge flow of burnt gas-air mixture. FIG. 2 substantially shows the two-part configuration of the spark plug mounting 60 with the inner portion 19 and the outer portion 20, between which the temperature control medium chamber 21 is arranged. The thickness D of the inner portion 19 is preferably about 3 mm. It will be seen from this view that the laser spark plug 50*a*, by way of a fastening region 7, can be screwed in the spark plug mounting 60 by way of a screw-in fitment portion 15 and interposed sealing element 6. The laser spark plug 50*a* itself has a laser light producing device 2 for the laser light beam 3 which radiates through the optical lenses (not shown here) to the coupling-in optical device 10, whereby ignition of an introduced inflammable mixture occurs in the prechamber 22 at the focal point 11.

Figure 3:
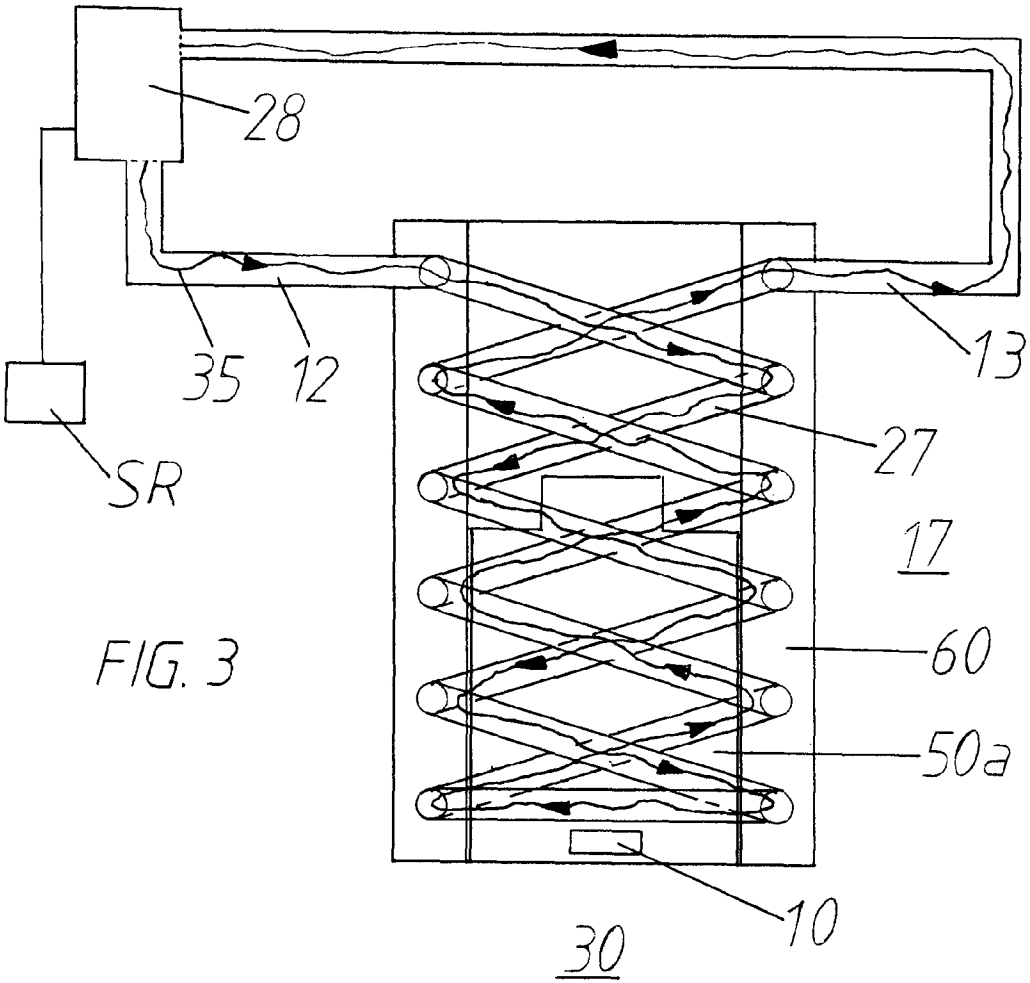
FIG. 3 shows a diagrammatic view of the oppositely directed double-helical passage of the temperature control medium chamber in the spark plug mounting.

FIG. 3 shows the helical configuration of the passage 27 in the spark plug mounting 60. In this case the cooling medium 35, coming from the cooling medium temperature control device 28, flows from the end remote from the combustion chamber in the direction towards the combustion chamber of the spark plug mounting 60 (in which here, for example, the coupling-in optical device 10 of the laser spark plug 50*a* is disposed) and then wound back again to the cooling medium discharge 13 at the combustion chamber side. Depending on the desired temperature control effect, the downward and upward chamber portions of the passage 27, can also be substantially closer together. For example, the individual chamber portions can be separated from each other in the axial direction only by limbs which are a few millimeters (for example 0.5-3 mm) thick. The spacings of the chamber portions relative to each other do not have to be regular but can be closer together in the region of strong heat-generating regions and thus deploy a better cooling action. In comparison to the illustrated cross-section of the passages 27, they can be substantially larger in comparison with the thickness of the spark plug mounting 60.

Figure 4:
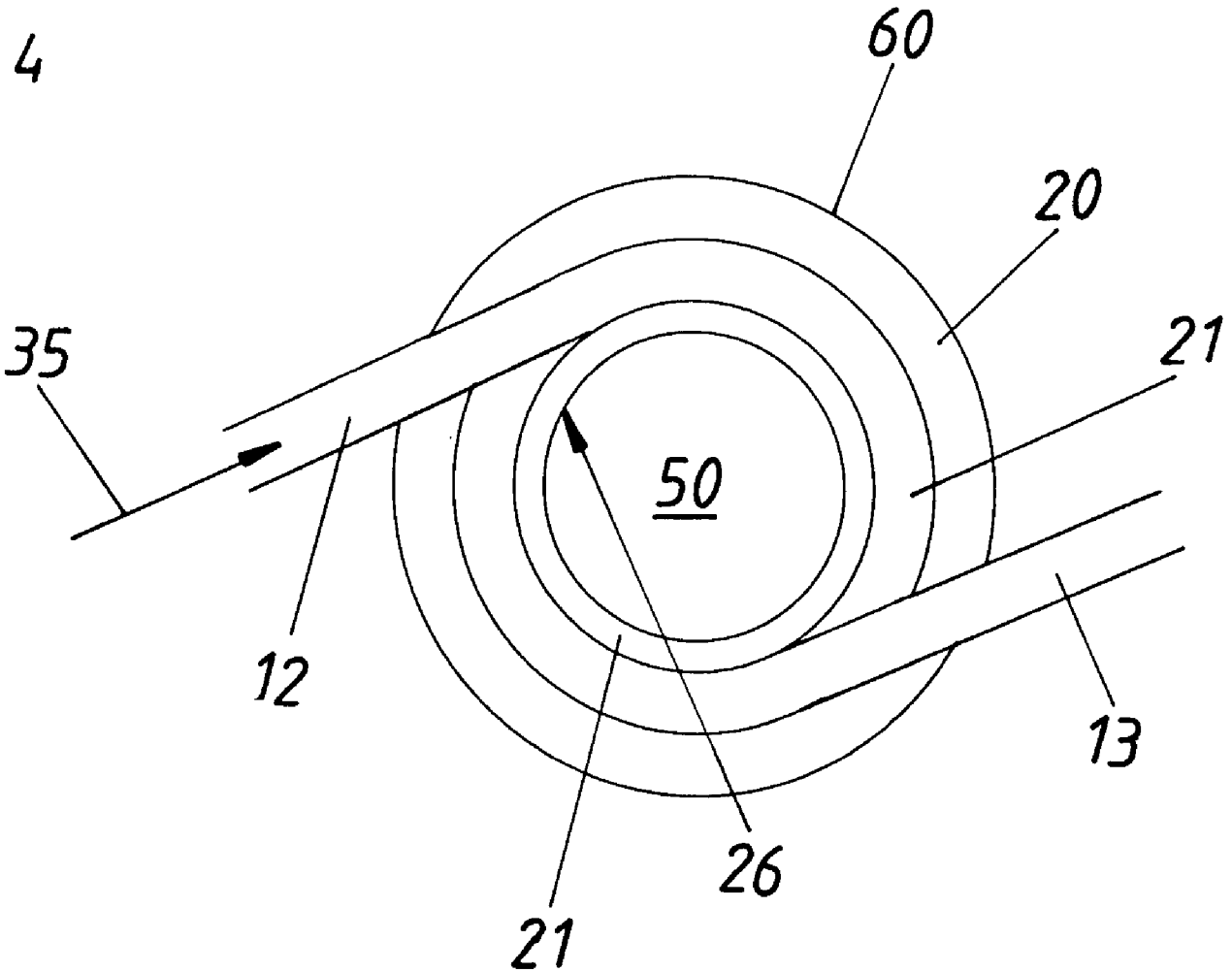
FIG. 4 shows a diagrammatic horizontal section through the spark plug mounting together with feed and discharge conduits.

FIG. 4 shows the tangential entry of the cooling medium 35 into the temperature control medium chamber 21, whereby a twisting (helical) swirl flow can be produced around the spark plug 50 disposed in the spark plug mounting 60, whereupon discharge is again tangential through the medium discharge conduit 13.

Thus, the present invention here shows a temperature control device which is substantially improved over the state of the art for spark plugs or spark plug mountings. On the one hand, this is achieved in that there are provided two separate temperature control medium regions for cylinder head and spark plug mounting. On the other hand, the helical configuration of the passage in the spark plug mounting affords radially homogeneous temperature distribution and thus a temperature control option which can be very well adjusted.

The invention claimed is:

1. An engine arrangement comprising:

a cylinder head having a cylinder head cooling cavity;

a first cooling medium temperature control device for controlling a flow of cooling medium through said cylinder head cooling cavity;

an internal combustion engine ignition device including a spark plug mounting and a spark plug fastened in a fastening region of said spark plug mounting, said spark plug being mounted in said cylinder head via said spark plug mounting, said spark plug mounting having a temperature control medium chamber separate from said cylinder head cooling cavity and having a cooling medium feed conduit and a cooling medium discharge conduit;

a second cooling medium temperature control device for controlling a flow of cooling medium through said temperature control medium chamber; and a regulating unit for controlling both said first cooling medium temperature control device and said second cooling medium temperature control device.

2. The engine arrangement of claim 1, wherein said spark plug is a laser spark plug having a laser light producing device and a coupling-in optical device arranged at a combustion chamber side of said spark plug for coupling laser light into a combustion chamber of an internal combustion engine.

3. The engine arrangement of claim 1, wherein said spark plug mounting has an inner portion and an outer portion, said temperature control medium chamber being located between said inner portion and said outer portion.

4. The engine arrangement of claim 3, wherein said inner portion of said spark plug mounting has a maximum thickness of 5 mm over substantially an entire mounting length of said spark plug.

5. The engine arrangement of claim 1, wherein said spark plug mounting has a sleeve-shaped configuration.

6. The engine arrangement of claim 5, wherein said temperature control medium chamber is formed as a passage having a spiral configuration around a central axis of said sleeve-shaped spark plug mounting.

7. The engine arrangement of claim 1, wherein said spark plug mounting has an inwardly disposed fixing region for receiving said spark plug.

8. The engine arrangement of claim 1, wherein said temperature control medium chamber extends substantially an entire length of said spark plug mounting.

9. The engine arrangement of claim 1, wherein said cooling medium feed conduit and said cooling medium discharge conduit are arranged at an end of said spark plug mounting remote from a combustion chamber.

10. The engine arrangement of claim 1, wherein said regulating unit is configured to regulate at least one of a temperature and a quantitative through-put of the cooling medium in said temperature control medium chamber based on engine load or an engine operating condition.

11. An engine arrangement comprising:

a cylinder head having a cylinder head cooling cavity;

a first cooling medium temperature control device for controlling a flow of cooling medium through said cylinder head cooling cavity;

an internal combustion engine ignition device including a spark plug mounting and a spark plug fastened in a fastening region of said spark plug mounting, said spark plug being mounted in said cylinder head via said spark plug mounting, said spark plug mounting having a temperature control medium chamber separate from said cylinder head cooling cavity and having a cooling medium feed conduit and a cooling medium discharge conduit;

a second cooling medium temperature control device for controlling a flow of cooling medium through said temperature control medium chamber; and a regulating unit for regulating at least one of a temperature and a quantitative through-put of the cooling medium in said temperature control medium chamber based on engine load or an engine operating condition.

12. The engine arrangement of claim 11, wherein said spark plug is a laser spark plug having a laser light producing device and a coupling-in optical device arranged at a combustion chamber side of said spark plug for coupling laser light into a combustion chamber of an internal combustion engine.

13. The engine arrangement of claim 11, wherein said spark plug mounting has an inner portion and an outer portion, said temperature control medium chamber being located between said inner portion and said outer portion.

14. The engine arrangement of claim 13, wherein said inner portion of said spark plug mounting has a maximum thickness of 5 mm over substantially an entire mounting length of said spark plug.

15. The engine arrangement of claim 11, wherein said spark plug mounting has a sleeve-shaped configuration.

16. The engine arrangement of claim 15, wherein said temperature control medium chamber is formed as a passage having a spiral configuration around a central axis of said sleeve-shaped spark plug mounting.

17. The engine arrangement of claim 11, wherein said spark plug mounting has an inwardly disposed fixing region for receiving said spark plug.

18. The engine arrangement of claim 11, wherein said temperature control medium chamber extends substantially an entire length of said spark plug mounting.

19. The engine arrangement of claim 11, wherein said cooling medium feed conduit and said cooling medium discharge conduit are arranged at an end of said spark plug mounting remote from a combustion chamber.

20. An internal combustion engine ignition device comprising:

a spark plug mounting; and a spark plug fastened in a fastening region of said spark plug mounting, said spark plug configured to be mounted in a cylinder head via said spark plug mounting, said spark plug mounting having a temperature control medium chamber having a cooling medium feed conduit and a cooling medium discharge conduit;

wherein said temperature control medium chamber is formed as a helically-shaped passage in said spark plug mounting, said helically-shaped passage extending from a first end of said spark plug mounting remote from a combustion chamber toward a second end of said spark plug mounting closest to the combustion chamber, and said helically-shaped passage extending with opposite helicity from said second end of said spark plug mounting back to said first end of said spark plug mounting.

21. The internal combustion engine ignition device of claim 20, wherein said spark plug is a laser spark plug having a laser light producing device and a coupling-in optical device arranged at a combustion chamber side of said spark plug for coupling laser light into the combustion chamber of an internal combustion engine.

22. The internal combustion engine ignition device of claim 20, wherein said spark plug mounting has an inner portion and an outer portion, said temperature control medium chamber being located between said inner portion and said outer portion.

23. The internal combustion engine ignition device of claim 22, wherein said inner portion of said spark plug mounting has a maximum thickness of 5 mm over substantially an entire mounting length of said spark plug.

24. The internal combustion engine ignition device of claim 20, wherein said spark plug mounting has a sleeve-shaped configuration.

25. The internal combustion engine ignition device of claim 20, wherein said spark plug mounting has an inwardly disposed fixing region for receiving said spark plug.

26. The internal combustion engine ignition device of claim 20, wherein said temperature control medium chamber extends substantially an entire length of said spark plug mounting.

27. The internal combustion engine ignition device of claim 20, wherein said cooling medium feed conduit and said cooling medium discharge conduit are arranged at said first end of said spark plug mounting remote from the combustion chamber.

28. The internal combustion engine ignition device of claim 20, further comprising a regulating unit for regulating at least one of a temperature and a quantitative through-put of the cooling medium in said temperature control medium chamber based on engine load or an engine operating condition.

* * * * *